US006109059A

United States Patent [19]

Lebrun

[11] Patent Number: 6,109,059

[45] Date of Patent: Aug. 29, 2000

[54] DISPENSER CAN COOLER

[76] Inventor: Camil Lebrun, 605, Grand Rang Nord, Albanel, Québec, Canada, G8M 3L4

[21] Appl. No.: 09/115,648

[22] Filed: Jul. 15, 1998

[51] Int. Cl.[7] ..... F25D 3/08

[52] U.S. Cl. ..... 62/457.5; 62/457.4; 62/457.7; 221/150 R

[58] Field of Search ..... 62/457.4, 457.5, 62/457.7; 221/150 R

[56] References Cited

U.S. PATENT DOCUMENTS

| | | | |
|---|---|---|---|
| 3,445,037 | 5/1969 | Rothbuam | 221/196 |
| 4,308,974 | 1/1982 | Jones | 221/196 |
| 4,510,770 | 4/1985 | Vella | 62/464 |
| 4,819,793 | 4/1989 | Willard et al. | 206/162 |
| 4,899,904 | 2/1990 | Dooley et al. | 220/413 |
| 5,247,798 | 9/1993 | Collard, Jr. | 62/3.62 |

*Primary Examiner*—Henry Bennett
*Assistant Examiner*—Mark Shulman
*Attorney, Agent, or Firm*—Eric Fincham

[57] ABSTRACT

A portable cooler for beverage containers and other food products wherein there is provided at least one compartment with access thereto being located in the top, the compartment being divisible into a lower section and an upper section by a divider member, and dispensing means located at a dispensing outlet formed in a side wall of the container for dispensing a single beverage container.

7 Claims, 3 Drawing Sheets

DISPENSER CAN COOLER

BACKGROUND OF THE INVENTION

The present invention relates to the field of portable coolers and more particularly, relates to portable coolers having selective cooling areas for beverages and other products.

The increasing popularity of activities wherein portable coolers might be employed is well known. These various outdoor activities include camping, picnicking, sports activities, etc. Participants frequently require readily portable coolers suitable for carrying both refrigerated beverages and other products such as sandwiches, fresh fruits and vegetables, etc. Unfortunately, the cooling requirements of the two types of food are not necessarily compatible. Many people prefer the beverages to be relatively cold while it is undesirable to maintain some products such as fresh fruits at such relatively cool temperatures.

Generally, the prior art has been directed either to portable coolers which contain a single compartment into which one must put all products including both beverages and other items or alternatively, the art has shown portable coolers strictly for a single type of product such as beverages.

SUMMARY OF THE INVENTION

It is an object of the present invention to provide a portable cooler having separate sections for refrigerated beverages and other food products.

It is a further object of the present invention to provide various sized coolers ranging from those suitable for personal use to larger ones for family use with each having multiple sections.

It is a further object of the present invention to provide a multi-section portable cooler having means for dispensing a refrigerated beverage container.

According to one aspect of the present invention, there is provided a portable cooler for beverage containers and other food products comprising a container having a bottom wall, an end wall, a side wall, and a top, a compartment being formed within the container; an access opening to the compartment being located in the top; a lid sized to cover the access opening; a dispensing outlet being located in a lower portion of the end wall; at least a portion of an inwardly facing surface of the bottom wall having a downwardly sloping configuration terminating proximate the dispensing outlet; dispensing means located at the dispensing outlet for dispensing a single beverage container; a divider member sized to fit within the compartment to thereby divide the compartment into a lower section and an upper section; and divider support means for supporting the divider member at a desired location spaced from the bottom wall.

According to a further aspect of the present invention, there is provided a portable cooler for beverage containers and other food products comprising a container having a bottom wall, a pair of opposed side walls, a pair of opposed end walls, and a top, first and second compartments being formed within the container; first and second access openings in the top to the first and second compartments respectively; first and second lids sized to cover the first and second access openings respectively; at least a portion of an inwardly facing surface of the bottom wall in the first compartment having a downwardly sloping configuration terminating proximate the first end wall, a dispensing outlet being located in a lower portion of the first end wall proximate the point of termination of the downwardly sloping surface of the bottom wall; dispensing means located at the dispensing outlet for dispensing a single beverage container.

In greater detail, the portable cooler of the present invention may be constructed in different sizes ranging from a smaller personal type cooler for use by one or two people to a larger family size unit. Different arrangements of the compartments are possible depending upon the size of the cooler.

The cooler may be constructed of conventional materials which are well known to those skilled in the art. Thus, the use of inner and outer shells with a thermal insulating material sandwiched therebetween is known and can be used for fabricating the portable cooler of the present invention.

BRIEF DESCRIPTION OF THE DRAWINGS

Having thus generally described the invention, reference will be made to the accompanying drawings illustrating an embodiment thereof, in which.

DESCRIPTION OF THE PREFERRED EMBODIMENTS

Figure 1:
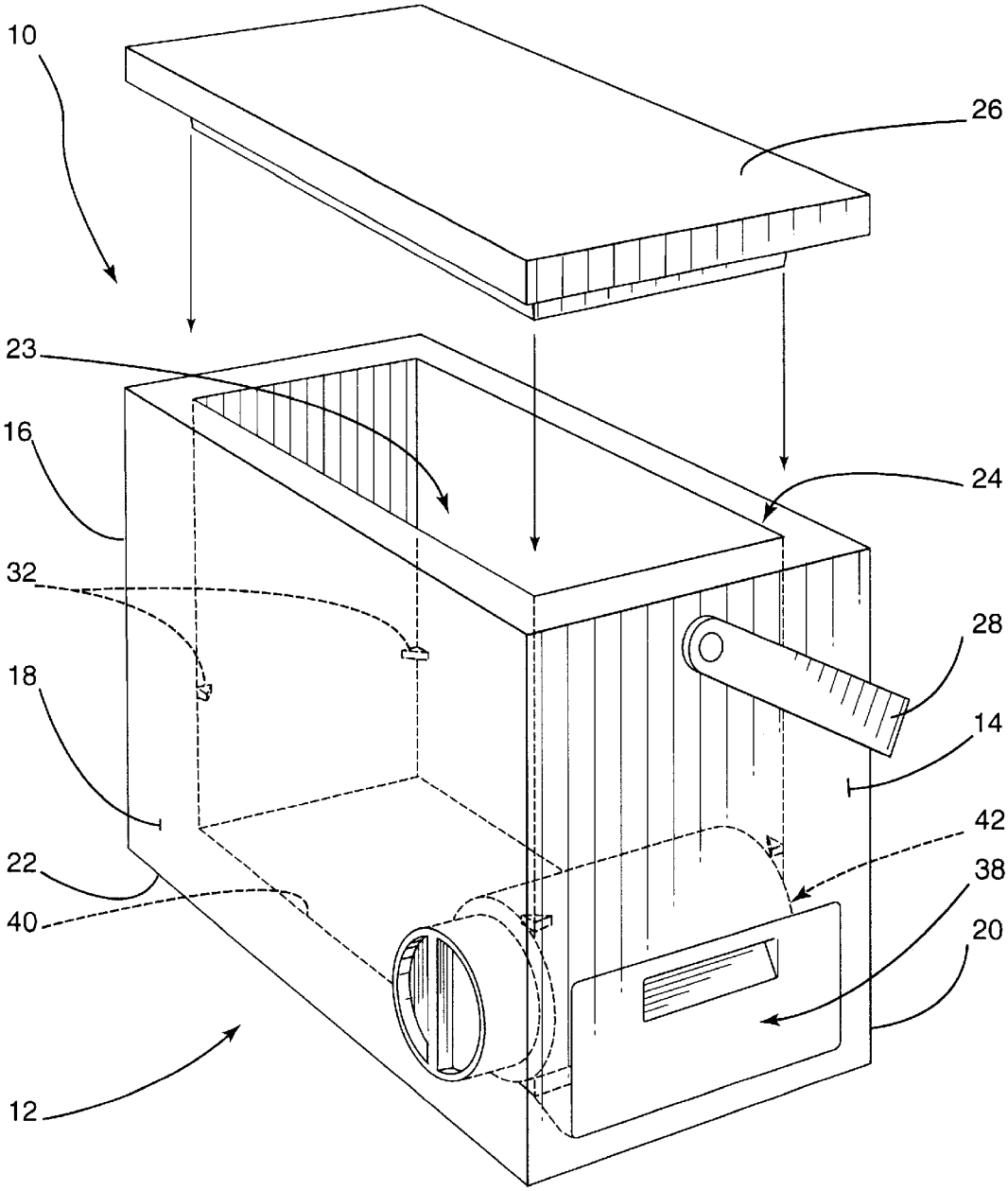
FIG. 1 is a perspective exploded view of a portable cooler with a lid according to one embodiment of the present invention.

Referring to the drawings in greater detail and by reference characters thereto, there is illustrated a portable cooler which is generally designated by reference numeral 10 and which portable cooler 10 includes a main body in the form of a container 12. Container 12 has first and second opposed end walls 14, 16 and first and second opposed side walls 18, 20 and a bottom wall 22. Defined between the end walls 14, 16 and side walls 18, 20 and bottom wall 22 is a compartment which is generally designated by reference numeral 23. Compartment 23 includes a top access opening generally designated by reference numeral 24 which is designed to be covered by a lid 26. A conventional handle 28 may be secured to end walls 14, 16.

Figure 2:
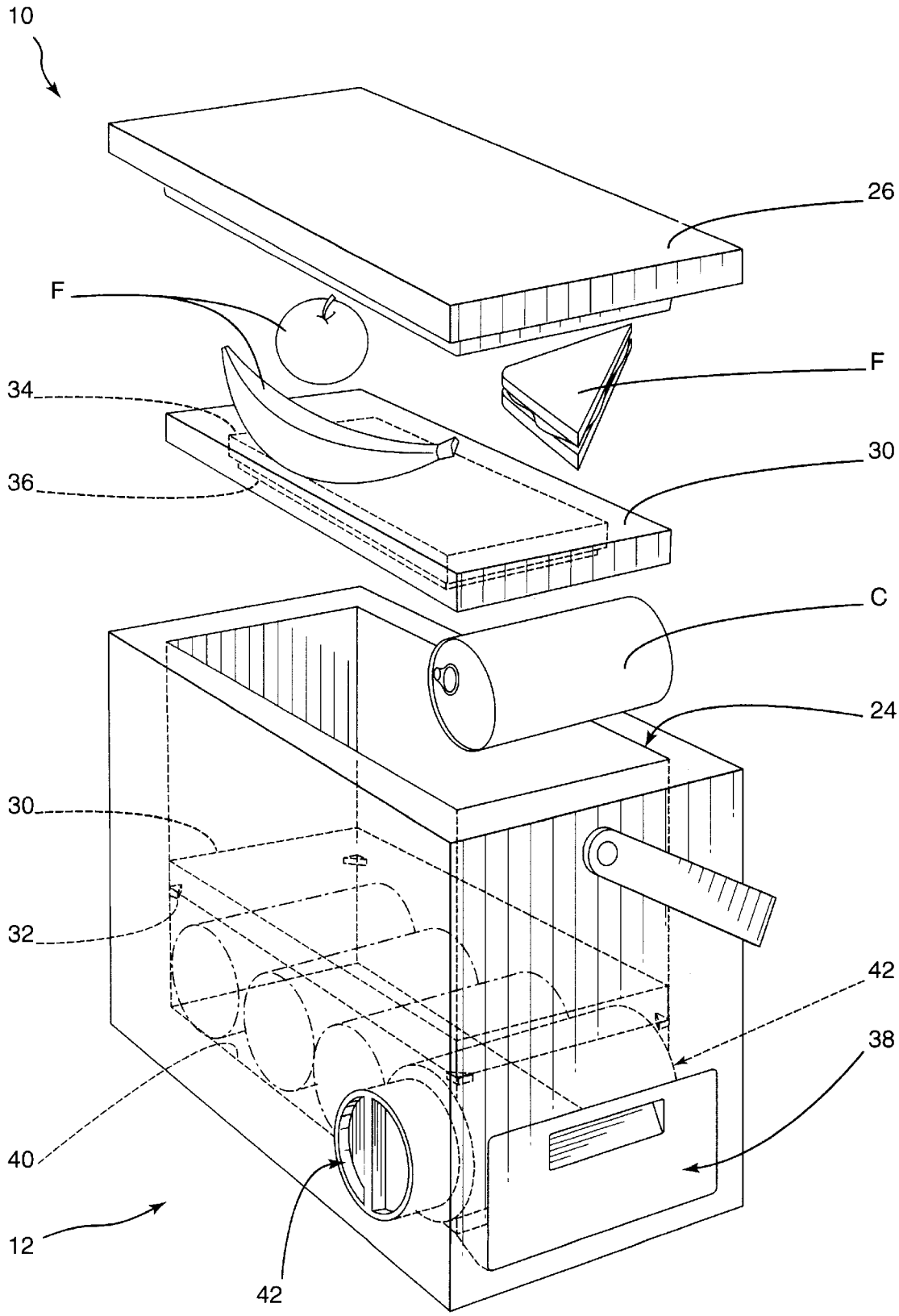
FIG. 2 is a perspective exploded view illustrating the placement of product within the portable cooler according to the embodiment of FIG. 1 of the present invention.

Container 12 may be divided into an upper section and a lower section and to this end, there is provided a divider 30 which is designed to seat on divider support members 32 formed on the interior walls of container 12. Divider 30 may, as shown in FIG. 2, include a recess 34 designed to receive an ice pack 36. In so doing, differential cooling of the two sections may be provided.

Located within end wall 14 at a lower portion thereof is a dispensing outlet 38. As will noted in FIGS. 1, 2 and 5, bottom wall 22 has a sloping interior surface 40 which slopes downwardly in the direction of dispensing outlet 38.

Figure 3:
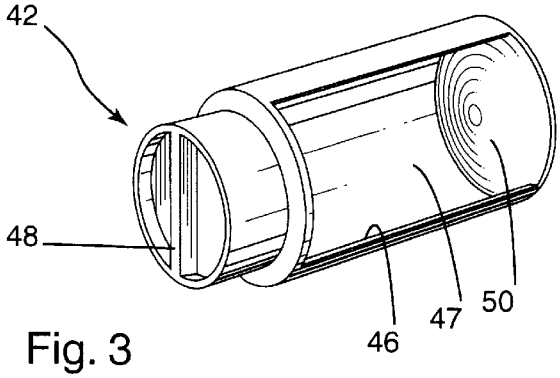
FIG. 3 is a perspective view of the dispensing member used with the portable cooler for dispensing beverage containers.
Figure 4:
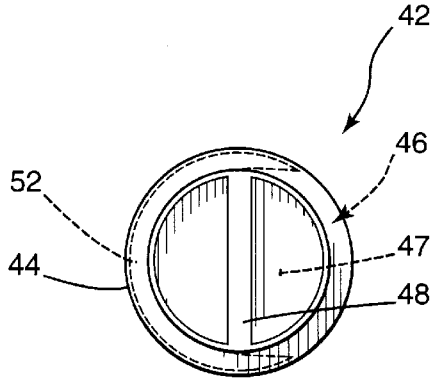
FIG. 4 is an end view of the dispensing member of FIG. 3.

Mounted at the dispensing outlet 38 is a dispensing member 42 which is best illustrated in FIGS. 3 and 4.

Dispensing member 42 is of a generally cylindrical configuration and having a cylindrical side wall 44 which has a longitudinally extending opening 46 to provide an interior recess 47. Located at one end of dispensing member 42 is a knob 48 while at the opposed end, dispensing member 42 is provided with a convex surface 50. It will be seen that a portion of side wall 44 has insulation 52 formed therealong.

Dispensing member 42 is placed adjacent dispensing outlet 38 with convex surface 50 meeting with a corresponding concave surface (not shown) within side wall 20 while knob 48 extends through side wall 18.

In use, portable cooler 10 may conveniently carry a plurality of beverage containers C in its lower section and which beverage containers C may be kept at a suitable temperature by use of an ice pack 36. Other food products F may be placed on top of divider 30 and are maintained at a slightly cool temperature, but not as cold as beverage containers C.

When it is desired to dispense a beverage container, knob 48 may be rotated. A single beverage container C enters recess 47 and knob 48 is turned through 180 degrees.

Figure 5:
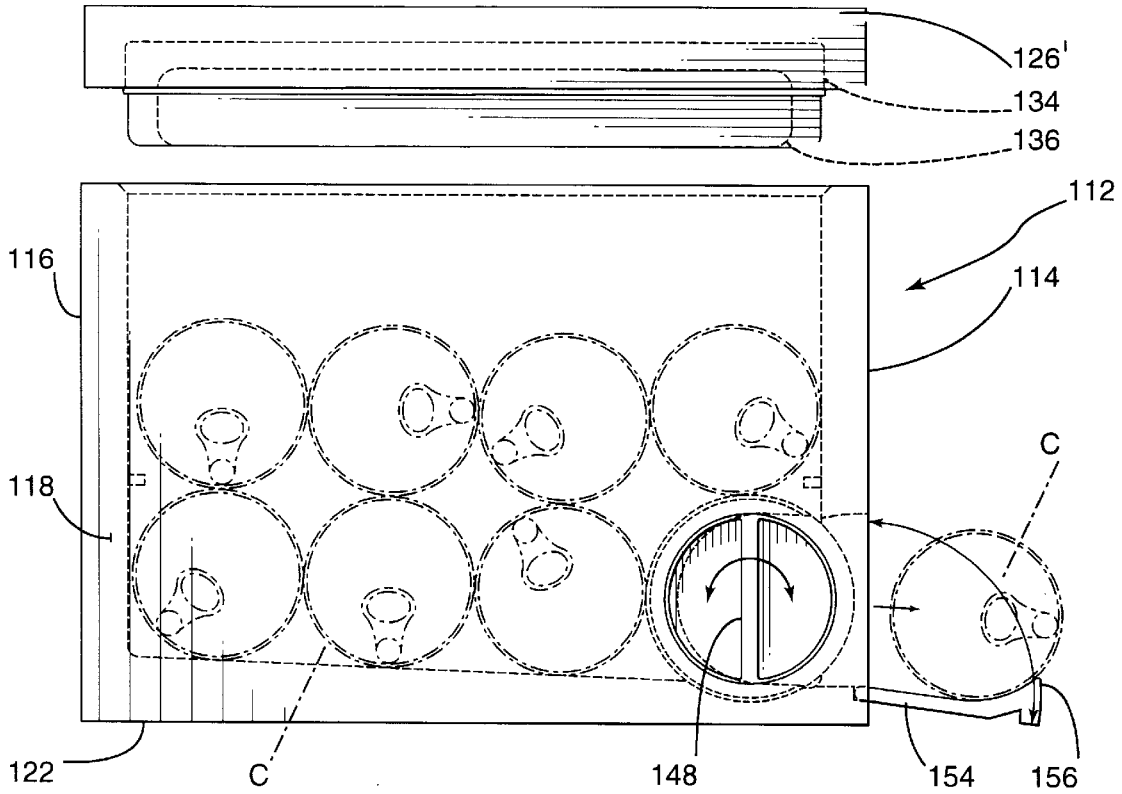
FIG. 5 is a side elevational view of the portable container illustrating a dispensing of a beverage container.
Figure 6:
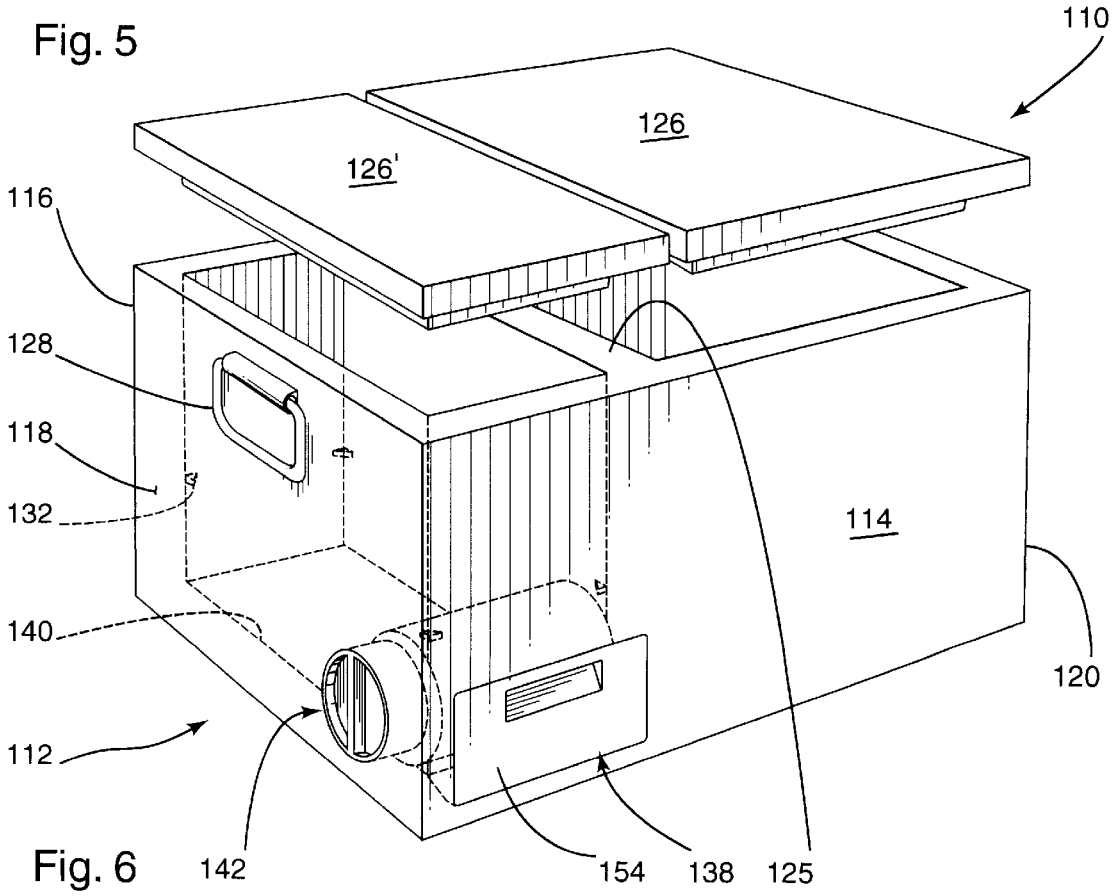
FIG. 6 is a perspective view of a further embodiment of the present invention.

A variation of the portable cooler 10 is shown in FIGS. 5 and 6 and reference will now be had thereto. In this respect, as many components are the same, similar reference numerals numbered in the 100s are employed for similar components.

Portable cooler 110 is designed for larger groups than portable cooler 10. In this respect, portable cooler 110 comprises a container 112 defined by end walls 114, 116 and side walls 118, 120. However, it will be noted that there are two side by side compartments formed by a dividing wall 125 with each compartment having a separate lid 126, 126'. A handle 128 is provided for carrying portable cooler 110.

Interiorly, the beverage container portion has a dispensing outlet 138 with a downwardly sloping surface or floor 140. A dispensing member 142 is provided as in the previously described embodiment.

In the embodiment of FIGS. 5 and 6, there is provided a door 154 which is hingedly connected at dispensing outlet 138 and which door 154 includes a stopper 156. Door 154 is preferably spring biased to a normally closed position. During operation of the dispensing member 142, the weight of beverage container C is sufficient to open door 154 and thereby present the beverage container to the user.

In this arrangement, one portion may be used solely for beverage containers with the other portion being used for other food products. In the embodiment illustrated, there are provided divider support members 132 which may be used to further divide the beverage container compartment into an upper section and a lower section.

It will be understood that the above described embodiments are for purposes of illustration only and that changes and modifications may be made thereto without departing from the spirit and scope of the invention.

I claim:

1. A portable cooler for beverage containers and other food products comprising a container having a bottom wall, an end wall, a side wall, and a top, a compartment being formed within said container;

an access opening to said compartment being located in said top;

a dispensing outlet being located in a lower portion of said end wall;

at least a portion of an inwardly facing surface of said bottom wall having a downwardly sloping configuration terminating proximate said dispensing outlet;

a hinged door covering said dispensing outlet, said door having door stop means on an inner wall thereof;

dispensing means located proximate said dispensing outlet for dispensing a single beverage container;

a divider member sized to fit within said compartment to thereby divide said compartment into a lower section and an upper section; and divider support means for supporting said divider member at a desired location spaced from said bottom wall; said dispensing means comprising a dispensing member mounted at said dispensing outlet, said dispensing member having means for receiving a single beverage container and means for delivering said single beverage container to said dispensing opening while blocking access of any remaining beverage containers to said dispensing outlet;

said dispensing member comprising a rotatable cylindrically shaped dispensing member rotatably mounted at said dispensing outlet, said cylindrically shaped dispensing member having a recess formed in a side wall thereof, said recess being sized to receive a beverage container, the arrangement being such that when said cylindrically shaped dispensing member is in a first position, a beverage container may enter said recess from within said lower section of said compartment and wherein rotation of said dispensing member will present said beverage container within said recess to said dispensing outlet, said hinged door being movable between a closed position end an open position, said door being hinged such that when said door is in an open position, said beverage container presented to said dispensing outlet will move along said inner wall of said door to said door stop means, said cylindrically shaped dispensing member having a knob extending through said side wall of said container.

2. The portable cooler of claim 1 wherein said side wall of said cylindrically shaped dispensing member is thermally insulated.

3. The portable cooler of claim 1 wherein said divider support means comprises a plurality of support members mounted on an interior wall surface surrounding said compartment.

4. The portable cooler of claim 1 wherein said divider member is thermally insulated.

5. The portable cooler of claim 4 wherein said divider member has a recess formed therein, said recess being designed to receive an ice pack.

6. The portable cooler of claim 1 wherein said compartment is sized to receive a plurality of cylindrically shaped beverage containers with said beverage containers being stacked on their side walls.

7. The portable cooler of claim 1 further including a door located at said dispensing outlet, said door being movable between open and closed positions.

* * * * *